US009812818B2

(12) United States Patent
Tsai et al.

(10) Patent No.: US 9,812,818 B2
(45) Date of Patent: Nov. 7, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long-Fei Chen, New Taipei (TW); Dong Xiang, New Taipei (TW); Da-Wei Zhu, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/270,464

(22) Filed: Sep. 20, 2016

(65) Prior Publication Data

US 2017/0085040 A1 Mar. 23, 2017

(30) Foreign Application Priority Data

Sep. 21, 2015 (CN) ..... 2015 2 0726962 U

(51) Int. Cl.

| | |
|---|---|
| ***H01R 13/659*** | (2011.01) |
| ***H01R 13/6596*** | (2011.01) |
| *H01R 24/60* | (2011.01) |
| *H01R 13/6585* | (2011.01) |
| *H01R 107/00* | (2006.01) |
| *H01R 43/20* | (2006.01) |

(52) U.S. Cl.

CPC ..... *H01R 13/6596* (2013.01); *H01R 13/6585* (2013.01); *H01R 24/60* (2013.01); *H01R 43/20* (2013.01); *H01R 2107/00* (2013.01)

(58) Field of Classification Search

CPC ..... H01R 24/60

See application file for complete search history.

(56) References Cited

U.S. PATENT DOCUMENTS

| | | | | |
|---|---|---|---|---|
| 9,484,679 | B2 * | 11/2016 | Guo | H01R 13/6585 |
| 9,502,821 | B2 * | 11/2016 | Little | H01R 13/6582 |
| 2016/0294102 | A1 * | 10/2016 | Zhao | H01R 13/6581 |

* cited by examiner

*Primary Examiner* — Ross Gushi

(74) *Attorney, Agent, or Firm* — Muncy, Geissler, Olds & Lowe, P.C.

(57) ABSTRACT

An electrical receptacle connector includes a mount member received in a metallic shell. A tongue portion is integrally formed with a front end of the mount member. Accordingly, a grounding plate, first receptacle terminals, and second receptacle terminals that are at the front end of the mount member can be positioned. In addition, the front ends of the first receptacle terminals are held in a first surface of the tongue portion, and the front ends of the second receptacle terminals are held in a second surface of the tongue portion. Since the tongue portion and the mount member are formed integrally with each other, the first receptacle terminals, the second receptacle terminals, and the mount member can be firmly positioned with each other. Accordingly, when the connector is impacted by a foreign force, the components of the connector would not detach from each other easily.

11 Claims, 7 Drawing Sheets

| | | | | | | | | | | | | | |
|---|---|---|---|---|---|---|---|---|---|---|---|---|---|
| GND | TX1+ | TX1− | VBUS | CC1 | D+ | D− | SBU1 | VBUS | RX2− | RX2+ | GND | 31 |
| GND | RX1+ | RX1− | VBUS | SBU2 | D− | D+ | CC2 | VBUS | TX2− | TX2+ | GND | 41 |

Fig. 7

ELECTRICAL RECEPTACLE CONNECTOR

CROSS-REFERENCES TO RELATED APPLICATIONS

This non-provisional application claims priority under 35 U.S.C. §119(a) on Patent Application No. 201520726962.5 filed in China, P.R.C. on 2015 Sep. 21, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. Normally, the plastic core of a conventional USB type-C electrical receptacle connector is an assembly of several plastic components, and the upper receptacle terminals and the lower receptacle terminals are respectively assembled with the plastic components.

SUMMARY OF THE INVENTION

The plastic components are combined with each other merely by assembling means; once the plastic components cannot fitted with each other properly, the structural strength of the assembly is reduced and some of the plastic components may even detach off the assembly. Moreover, because contact portions of the receptacle terminals are not positioned by a tongue portion of the connector, the receptacle terminals may be detached from the plastic core during the operation. Therefore, how to solve the aforementioned problem is an issue.

In view of this, an embodiment of the instant disclosure provides an electrical receptacle connector. The electrical receptacle connector comprises a metallic shell, a mount member, a plurality of first receptacle terminals, a plurality of second receptacle terminals, a shielding plate, and a tongue portion. The metallic comprises a receptacle cavity. The mount member is received in the receptacle cavity of the metallic shell. The first receptacle terminals are on a first side of the mount member. Each of the first receptacle terminals comprises a first flat contact portion and a first tail portion extending from one end of the first flat contact portion and protruding from the mount member. The second receptacle terminals are on a second side of the mount member opposite to the first side. Each of the second receptacle terminals comprises a second flat contact portion and a second tail portion extending from one end of the second flat contact portion and protruding from the mount member. The grounding plate is on the mount member and between the first flat contact portions and the second flat contact portions. The tongue portion is integrally formed with a front end of the mount member to enclose the grounding plate. The first flat contact portions are on a first surface of the tongue portion. The second flat contact portions are on a second surface of the tongue portion opposite to the first surface. Front ends of the first flat contact portions are held in the first surface of the tongue portion. Front ends of the second flat contact portions are held in the second surface of the tongue portion.

In one embodiment, the mount member comprises a first insulated member and a second insulated member assembled with each other. The first receptacle terminals are on the first insulated member. The second receptacle terminals and the grounding plate are on the second insulated member.

In one embodiment, the second insulated member comprises a base and a terminal positioning portion extending from one side of the base and on the second surface of the tongue portion.

In one embodiment, the second insulated member comprises a plurality of protrusions on an abutting surface of the terminal positioning portion to abut against the first flat contact portions.

In one embodiment, the grounding plate comprises a plurality of positioning holes. The protrusions pass through the positioning holes so as to be positioned with the grounding plate.

In one embodiment, the tongue portion comprises a specific portion and an assembling portion opposite to the specific portion. The terminal positioning portion is on the specific portion. The terminal positioning portion is held in the tongue portion. A surface texture of a surface of the terminal positioning portion opposite to the abutting surface is different from a surface texture of the second surface of the tongue portion.

In one embodiment, the second insulated member comprises a plurality of sidewalls and an assembling portion. The sidewalls are outward extending from two sides of the base in a same direction. The assembling portion is between the sidewalls. The first insulated member is positioned on the assembling portion, and two sides of the first insulated member are engaged with the sidewalls, respectively.

In one embodiment, the tongue portion is integrally formed with the front end of the mount member to enclose the terminal positioning portion.

In one embodiment, the tongue portion comprises a separating portion surrounding a periphery of a rear portion of the tongue portion and near to the front end of the mount member.

In one embodiment, the first receptacle terminals are on the first surface of the tongue portion, and the second receptacle terminals are on the second surface of the tongue portion. The first receptacle terminals and the second receptacle terminals have 180 degree symmetrical design with respect to a central point of the receptacle cavity as the symmetrical center.

Another embodiment of the electrical receptacle connector comprises a plurality of first receptacle terminals, a plurality of second receptacle terminals, a tongue portion, and a metallic shell. The first receptacle terminals are held in a first insulated member. Each of the first receptacle terminals comprises a first flat contact portion. The second receptacle terminals are held in a second insulated member along with a grounding plate. Each of second receptacle terminals comprises a second flat contact portion. The second insulated member has a terminal positioning portion positioned with the second flat contact portions. The terminal positioning portion comprises a disposing surface. Front ends of the second flat contact portions are held in the disposing surface. A first surface of the tongue portion comprises an assembling portion. A second surface of the tongue portion opposite to the first surface comprises a specific portion. The first flat contact portions are positioned with the assembling portion. Front ends of the first flat contact portions are held in the assembling portion. The terminal positioning portion is held in the tongue portion. The disposing surface of the terminal positioning portion and the specific portion of the tongue portion are at a same plane. A surface texture of the terminal positioning portion is different from a surface texture of the specific portion. The metallic shell comprises a receptacle cavity for receiving the first receptacle terminals and the second receptacle terminals.

Accordingly, the tongue portion is integrally formed on the front end of the mount member to enclose the terminal positioning portion and the grounding plate, so that the front ends of the flat contact portions of the first receptacle terminals are held in the first surface of the tongue portion and the front ends of the flat contact portions of the second receptacle terminals are held in the second surface of the tongue portion. The tongue portion encloses the front end of the second insulated member and integrates with the second insulated member, so that the tongue portion can be firmly positioned with the first receptacle terminals, the second receptacle terminals, the first insulated member, and the second insulated member. Therefore, when the connector is impacted by a foreign force, the components of the connector would not detach from each other easily. In addition, after the assembling procedures, the surface of the tongue portion and the surface of the mount member are different in texture for indicating different forming procedures. Moreover, the front portions of the first and second receptacle terminals are covered by the tongue portion and the terminal positioning portion, respectively. Accordingly, the flat contact portions of the electrical receptacle connector would not detach off the tongue portion and the terminal positioning portion after the connector is used for a period.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 7 illustrates a schematic configuration diagram of the receptacle terminals of the electrical receptacle connector.

DETAILED DESCRIPTION

Figure 1:
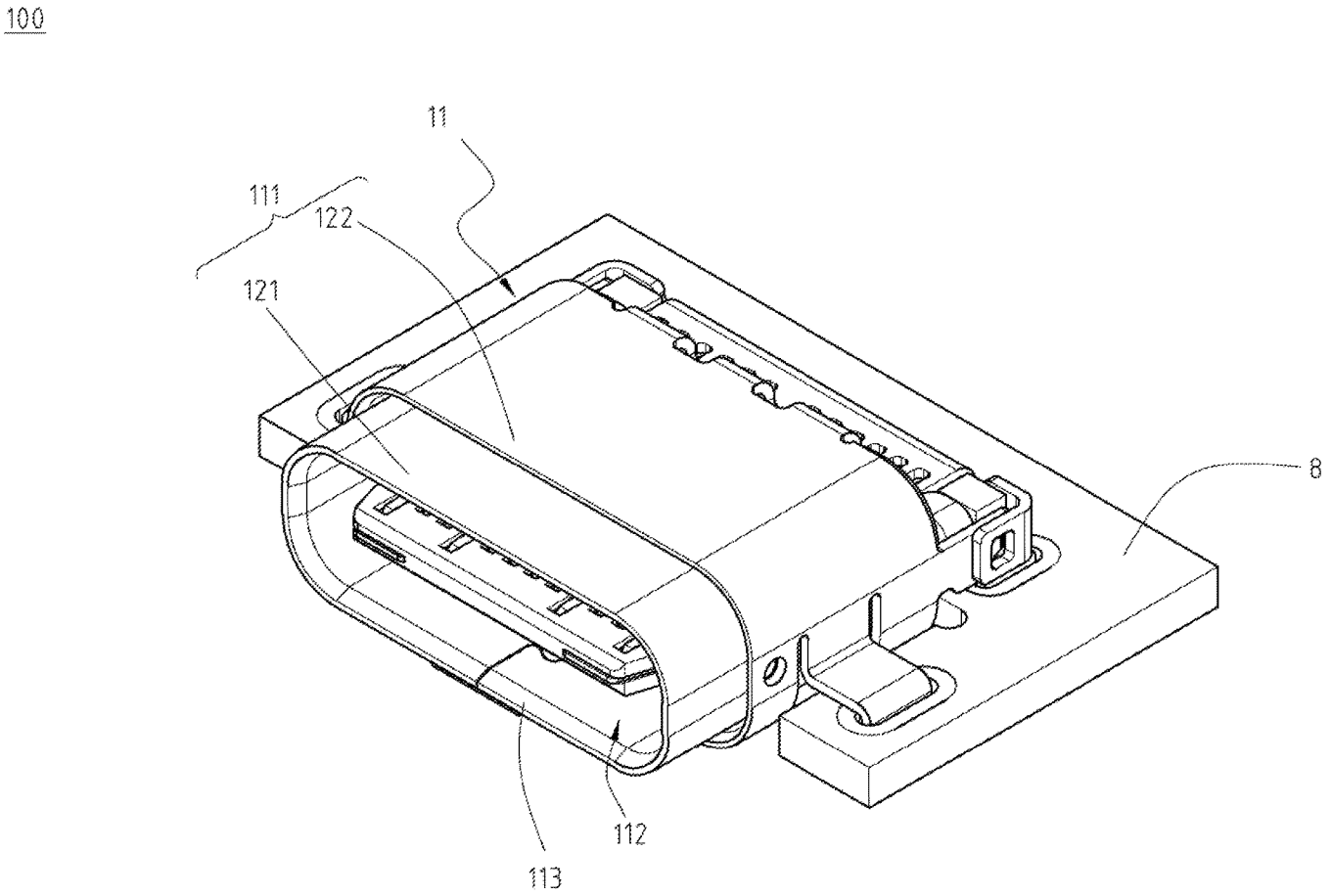
FIG. 1 illustrates a perspective view of an electrical receptacle connector according to an exemplary embodiment of the instant disclosure.
Figure 2:
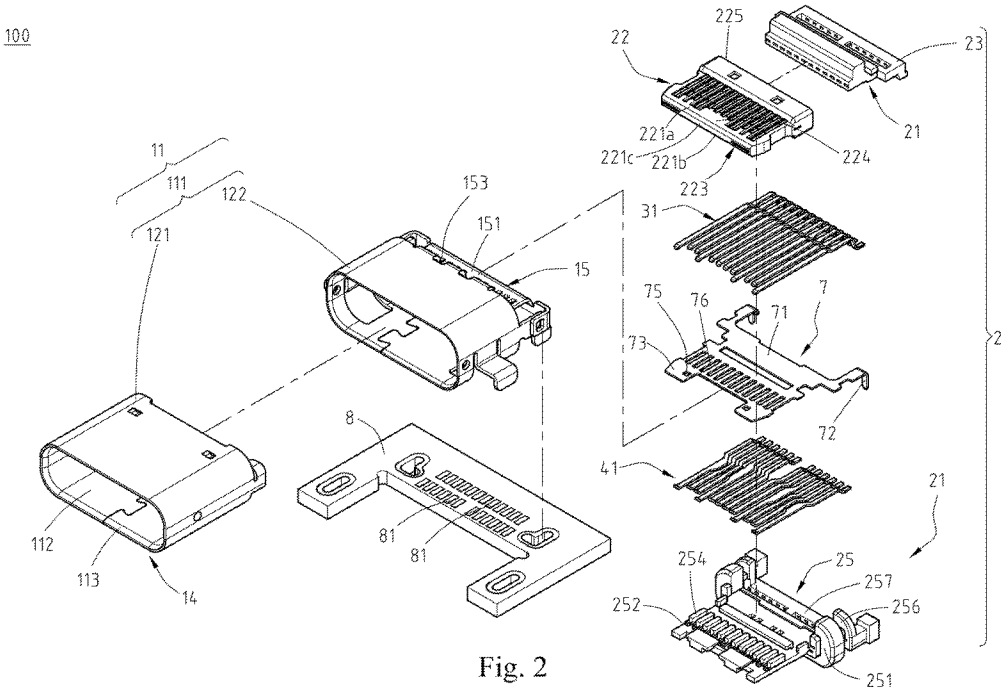
FIG. 2 illustrates an exploded view of the electrical receptacle connector.

Please refer to FIGS. 1 and 2, illustrating an electrical receptacle connector of an exemplary embodiment of the instant disclosure. FIG. 1 illustrates a perspective view of an electrical receptacle connector according to an exemplary embodiment of the instant disclosure. FIG. 2 illustrates an exploded view of the electrical receptacle connector. In this embodiment, the electrical receptacle connector 100 is assembled with a circuit board 8 by sinking technique. That is, one side of the circuit board 8 is cut to form a crack, and the electrical receptacle connector 100 is positioned at the crack and extending toward the side portion of the circuit board 8. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 11, a mount member 21, a plurality of first receptacle terminals 31, a plurality of second receptacle terminals 41, a grounding plate 7, and a tongue portion 22.

Please refer to FIGS. 1 and 2. In this embodiment, the metallic shell 11 is a hollowed shell, and the metallic shell 11 comprises a shell body 111 and a receptacle cavity 112 formed in the shell body 111. In other words, the metallic shell 11 comprises a receptacle cavity 112 for receiving the first receptacle terminals 31 and the second receptacle terminals 41. In this embodiment, the metallic shell 11 may be a tubular member 14 and the receptacle cavity 112 is formed in the tubular member 14. The metallic shell 11 may be formed by a multi-piece member; in such embodiment, the metallic shell 11 comprises an inner shell 121 and a cover shell 122, wherein the inner shell 121 is a hollowed shell and encloses the mount member 21, and the cover shell 122 is a hollowed shell and encloses the inner shell 121, but embodiments are not limited thereto. In some embodiments, the cover shell 122 may be a semi-tubular member having a U-shape cross section, and the semi-tubular member covers the top and the two sides of the inner shell 121. In addition, an insertion opening 113 with oblong shaped is formed on one side of the metallic shell 11, and the insertion opening 113 communicates with the receptacle cavity 112.

Please refer to FIGS. 1 and 2. In this embodiment, a terminal module 2 is received in the receptacle cavity 112 of the metallic shell 11. The terminal module 2 comprises the mount member 21, the first receptacle terminals 31, the second receptacle terminals 41, and the grounding plate 7.

Figure 4:
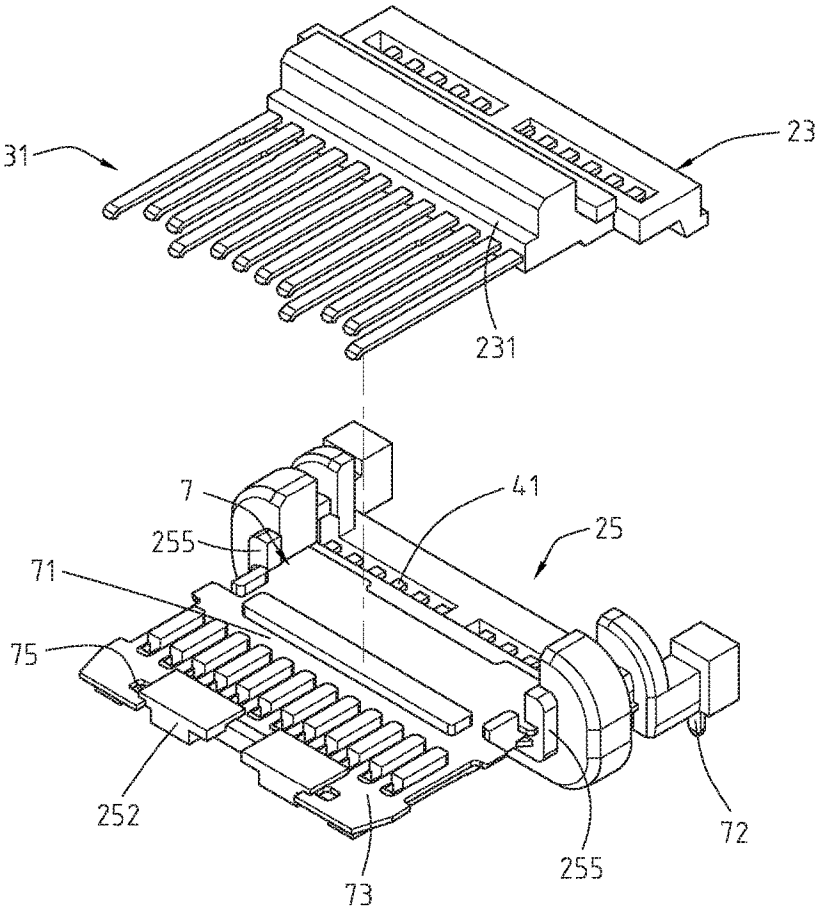
FIG. 4 illustrates a schematic view (1) showing an assembling procedure of the electrical receptacle connector.
Figure 5:
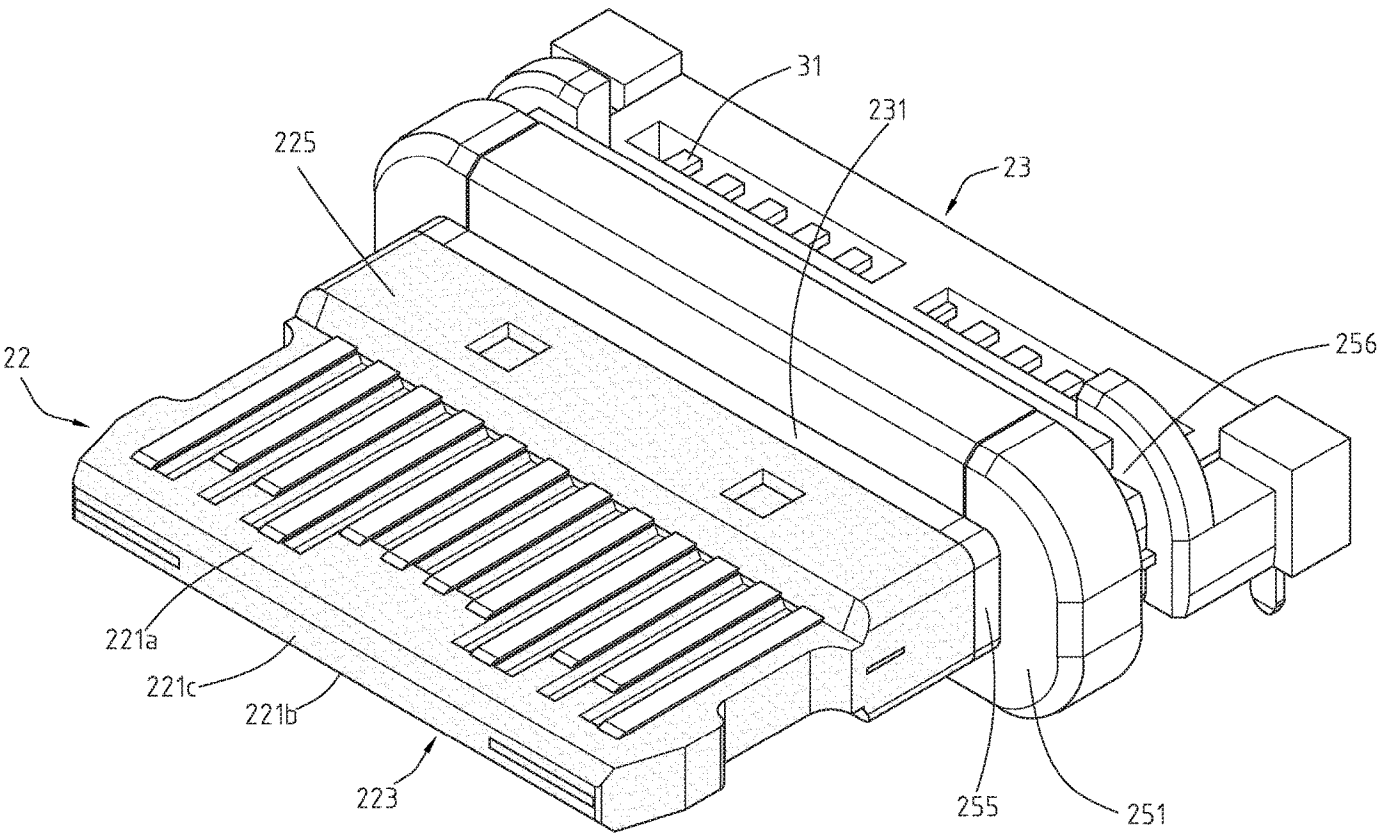
FIG. 5 illustrates a schematic view (2) showing an assembling procedure of the electrical receptacle connector.
Figure 6:
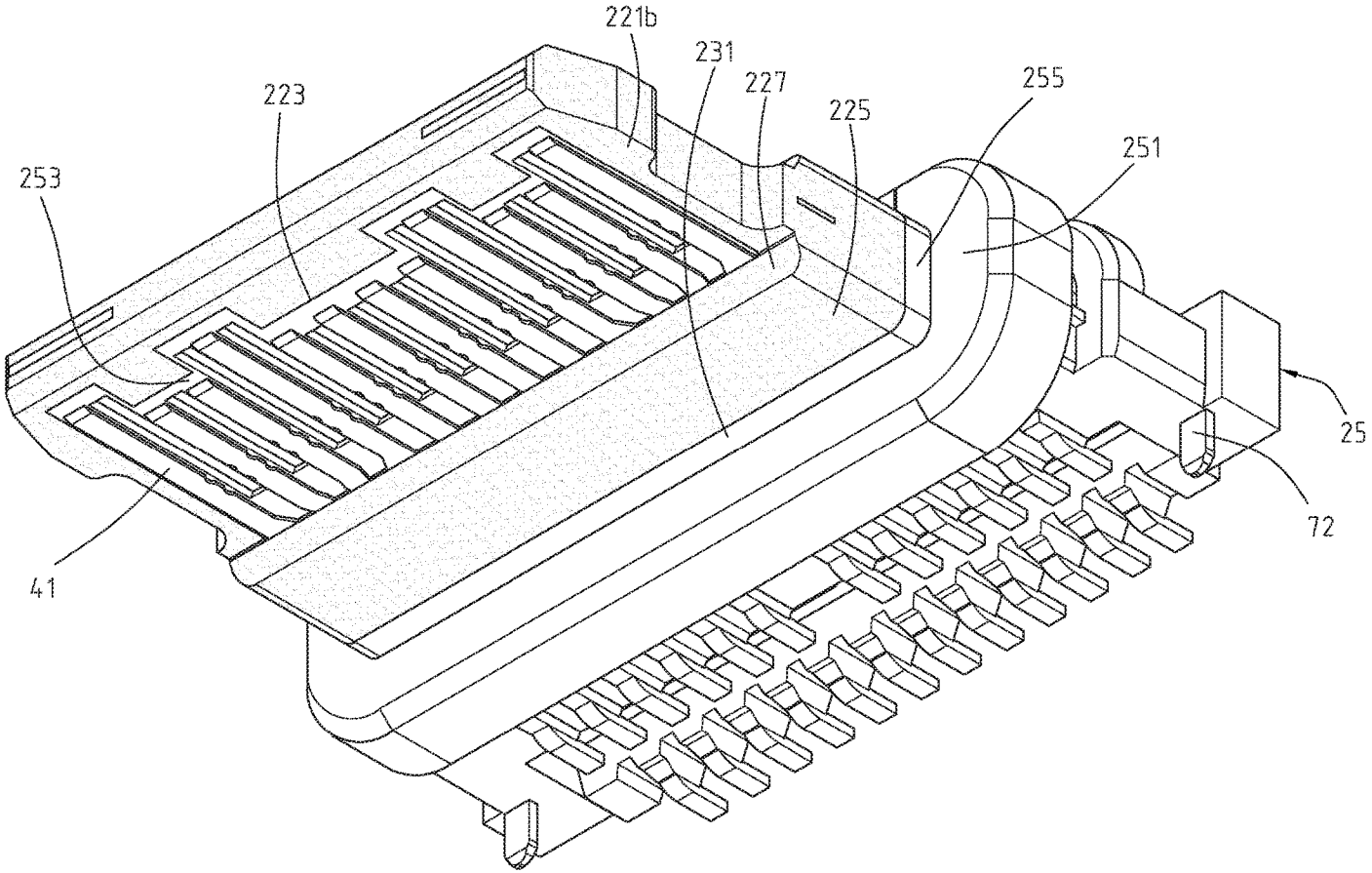
FIG. 6 illustrates another perspective view of the electrical receptacle connector.

Please refer to FIGS. 2 and 4 to 6. The mount member 21 is received in the receptacle cavity 112 of the metallic shell 11. The mount member 21 comprises a first insulated member 23 and a second insulated member 25 assembled with each other. The first receptacle terminals 31 are on the first insulated member 23, and the second receptacle terminals 41 and the grounding plate 7 are on the second insulated member 25. The second insulated member 25 comprises a base 251 and a terminal positioning portion 252 extending from one end of the base 251 and on a second surface 221*b* of the tongue portion 22. In this embodiment, the second insulated member 25 comprises a plurality of protrusions 254 on a surface of the terminal positioning portion 256 to abut against the flat contact portions 415. In addition, the second insulated member 25 comprises a plurality of sidewalls 256 and an assembling portion 257. The sidewalls 256 are outward extending from two sides of the base 251 in a same direction. The assembling portion 257 is between the sidewalls 256. The first insulated member 23 is positioned on the assembling portion 257, and two sides of the first insulated member 23 are engaged with the sidewalls 256, respectively. Moreover, the terminal positioning portion 252 is held in the tongue portion 22. The terminal positioning portion 252 comprises a disposing surface 253 (as shown in FIG. 6, the disposing surface 253 is opposite to the surface where the protrusions 254 are configured), and the disposing surface 253 is on the second surface 221*b* of the tongue portion 22. In detail, the first insulated member 23 further includes an assembling block 231, and the second insulated member 25 further includes two abutting blocks 255. The two abutting blocks 255 are extending from the two sides of the base 251 and extending along a direction parallel to the long axis of the terminal positioning portion 252. The assembling block 231 is disposed between the butting blocks 255.

Please refer to FIGS. 2, 5, and 6. The tongue portion 22 has two opposite surfaces, one is a first surface 221*a*, and the other is the second surface 221*b*. In addition, a front lateral surface 221*c* of the tongue portion 22 is connected the first surface 221*a* with the second surface 221*b* and is close to the insertion opening 113. In other words, the front lateral surface 221*c* is near to the insertion opening 113 and perpendicularly connected to the first surface 221*a* and the second surface 221*b*, respectively. In this embodiment, the two surfaces of the tongue portion 22 respectively comprise a specific portion 223 and an assembling portion 224 opposite to the specific portion 223. The assembling portion 224 is on the first surface 221*a* of the tongue portion 22, and the specific portion 223 is on the second surface 221*b* of the tongue portion 22. The terminal positioning portion 252 is on the specific portion 223. The terminal positioning portion 252 is held in the tongue portion 22. The second surface 221*b* of the tongue portion 22 and a surface of the mount member 21 are at a same horizontal plane, in detail, the disposing surface 253 of the terminal positioning portion 252 and the second surface 221*b* of the tongue portion 22 are at a same horizontal plane. The tongue portion 22 encloses the terminal positioning portion 252, and a surface texture of the disposing surface 253 of the terminal positioning portion 252 is different from a surface texture of the second surface 221*b* of the tongue portion 22.

Figure 3:
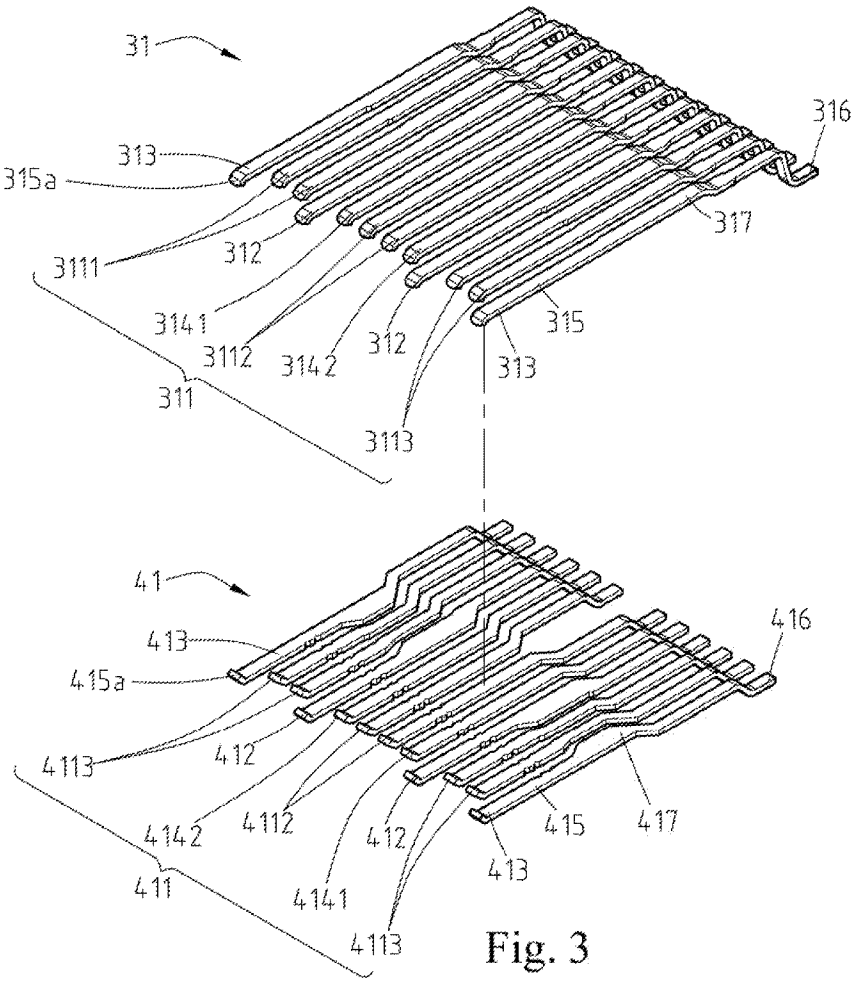
FIG. 3 illustrates an exploded view of the receptacle terminals of the electrical receptacle connector.

Please refer to FIGS. 2 to 4. The first receptacle terminals 31 are held in the first insulated member 23. Each of the first receptacle terminals 31 comprises a flat contact portion 315. In other words, the first receptacle terminals 31 are on a first side of the mount member 21, and each of the first receptacle terminals 31 comprises a flat contact portion 315 and a tail portion 316. The first flat contact portions 315 are positioned with the assembling portion 224, and front ends of the first flat contact portions 315 are held in the assembling portion 224. Each of the tail portions 316 is extending from one end of the corresponding flat contact portion 315 and protruding from the mount member 21.

Please refer to FIGS. 2 to 4. The second receptacle terminals 41 and the grounding plate 7 are held in the second insulated member 25. Each of the second receptacle terminals 41 comprises a flat contact portion 415. In other words, the second receptacle terminals 41 are on a second side of the mount member 21 opposite to the first side. Each of the second receptacle terminals 41 comprises a flat contact portion 415 and a tail portion 416. Each of the tail portions 416 is extending from one end of the corresponding flat contact portion 415 and protruding from the mount member 21.

Please refer to FIGS. 2 and 4. The grounding plate 7 is held in the mount member 21. The grounding plate 7 comprises a plate body 71 and a plurality of legs 72. The plate body 71 is between the flat contact portions 315 of the first receptacle terminals 31 and the flat contact portions 415 of the second receptacle terminals 41. Specifically, the plate body 71 may be lengthened and widened, so that the front of the plate body 71 is near to the front lateral surface 221*c* of the tongue portion 22, two sides of the plate body 71 is near to two sides of the tongue portion 22, and the rear of the plate body 71 is near to the rear of the second insulated member 25. Accordingly, the plate body 71 can be disposed on the tongue portion 22 and the second insulated member 25, and the structural strength of the tongue portion 22 and the shielding performance of the tongue portion 22 can be improved. Moreover, the grounding plate 7 comprises a plurality of positioning holes 76. The protrusions 254 pass through the positioning holes 76 to be positioned with the grounding plate 7.

Please refer to FIGS. 2, 4, and 5. In this embodiment, the terminal positioning portion 252 and the second receptacle terminals 41 are combined with each other in a first processing procedure. Next, the second insulated member 25 is assembled with an assembly of the second receptacle terminals 41 and the terminal positioning portion 252 as well as the grounding plate 7 by insert-molding techniques. Next, in a second processing procedure, the first insulated member 23 is assembled with the first receptacle terminals 31 by insert-molding techniques. Then, the first insulated member 23 is assembled to the second insulated member 25, so that the flat contact portions 315 are aligned on the protrusions 254 and the first insulated member 23 are engaged with the second insulated member 25. It is understood that, the processing procedures may be exchanged. That is, in a former procedure, the first insulated member 23 is assembled with the first receptacle terminals 31 by insert-molding techniques; and in a latter procedure, the terminal positioning portion 252 is combined with the second receptacle terminals 41 followed by assembling the assembly of the second receptacle terminals 41 and the terminal positioning portion 252 as well as the grounding plate 7 with the second insulated member 25. And, in a third processing procedure, the tongue portion 22 is formed in a mold, and the tongue portion 22 is combined to a front end of the second insulated member 25 by insert-molding techniques. In other words, the tongue portion 22 is integrally formed with the front end of the mount member 21 to enclose the terminal positioning portion 252 and the grounding plate 7. In the insert-molding procedure, glues in liquid state passes through holes 75 of the grounding plate 7 to enclose the terminal positioning portion 252. When the glues are dried and set, a tongue portion 22 in solid state can be formed. Moreover, the front ends 315*a* of the flat contact portions 315 are held in the first surface 221*a* of the tongue portion 22, and the front ends 415*a* of the flat contact portions 415 are held in the second surface 221*b* of the tongue portion 22. Accordingly, the tongue portion 22 encloses the front end of the second insulated member 25 and integrates with the second insulated member 25, so that the tongue portion 22 can be firmly positioned with the first receptacle terminals 31, the second receptacle terminals 41, the first insulated member 23, and the second insulated member 25. Therefore, when the connector is impacted by a foreign force, the components of the connector would not detach from each other easily.

Please refer to FIGS. 2, 5, and 6. In this embodiment, the tongue portion 22 is integrally formed with the front end of the mount member 21 to enclose the terminal positioning portion 252. The tongue portion 22 encloses most of the terminal positioning portion 252 and only an exposed surface (i.e., the disposing surface 253) of the terminal positioning portion 252 is exposed from the tongue portion 22. In addition, the exposed surface of the terminal positioning portion 252 and the second surface 221*b* of the tongue portion 22 are at the same horizontal plane. In other words, the terminal positioning portion 252 is approximately at the middle portion of the tongue portion 22. Moreover, the surface texture of the exposed surface of the terminal positioning portion 252 and the surface texture of the second surface 221*b* of the tongue portion 22 are different from each other (as shown in FIG. 5, portions with spots filled therein indicate the tongue portion 22; portions at the middle portion of the tongue portion 22 without spots filled therein indicate the exposed surface of the terminal positioning portion 252).

The terminal positioning portion 252 and the tongue portion 22 are formed in different insert-molding procedures, therefore the surface texture of the exposed surface of the terminal positioning portion 252 is different from the surface texture of the second surface 221*b* of the tongue portion 22. In other words, the surface structures between the two surfaces are different. Accordingly, when the surface structures between two surfaces are different, two components respectively having the two surfaces may be formed in different time durations. In this embodiment, the exposed surface of the terminal positioning portion 252 is rough, and the second surface 221*b* of the tongue portion 22 is smooth, but embodiments are not limited thereto. Alternatively, the exposed surface of the terminal positioning portion 252 may be smooth, and the second surface 221*b* of the tongue portion 22 may be rough.

Please refer to FIGS. 2, 5, and 6. In this embodiment, the tongue portion 22 comprises a separating portion 225 surrounding a periphery of a rear portion of the tongue portion 22 and near to the front end of the mount member 21. When the tongue portion 22 is insert-molded with the front end of the second insulated member 25, the separating portion 225 is a trace indicating that the tongue portion 22 and the second insulated member 25 are processed. Therefore, it can be understood that the tongue portion 22 and the rear portion of the second insulated member 25 are formed by different processing procedures (as shown in FIG. 5, the tongue portion 22 is indicated by portions filled with spots). The tongue portion 22 is a piece for mating with an electrical plug connector, while the terminal positioning member 252 is a semi-product structure filled in a hollowed portion of the tongue portion 22. In detail, the separating portion 225 is in contact with the assembling block 231 and the butting blocks 255. In addition, the second surface 221*b* is connected to the separating portion 225 via a step surface 227. A height offset is between the second surface 221*b* and the separating portion 225.

Please refer to FIGS. 2, 3, and 7. The first receptacle terminals 31 comprise a plurality of first signal terminals 311, power terminals 312, and ground terminals 313. The first signal terminals 31 comprises a plurality of pairs of first high-speed signal terminals 3111/3113 and a pair of first low-speed signal terminals 3112. Referring to FIG. 7, the first receptacle terminals 31 comprise, from left to right, a ground terminal 313 (Gnd), a first pair of first high-speed signal terminals 3111 (TX1+−, differential signal terminals for high-speed signal transmission), a power terminal 312 (Power/VBUS), a first function detection terminal 3141 (CC1, a terminal for inserting orientation detection of the connector and for cable recognition), a pair of first low-speed signal terminals 3112 (D+−, differential signal terminals for low-speed signal transmission), a supplement terminal 3142 (SBU1, a terminal can be reserved for other purposes), another power terminal 312 (Power/VBUS), a second pair of first high-speed signal terminals 3113 (RX2+−, differential signal terminals for high-speed signal transmission), and another ground terminal 313 (Gnd). In this embodiment, twelve first receptacle terminals 31 are provided for transmitting USB 3.0 signals. Each pair of the first high-speed signal terminals 3111/3113 is between the corresponding power terminal 312 and the adjacent ground terminal 313. The pair of the first low-speed signal terminals 3112 is between the first function detection terminal 3141 and the supplement terminal 3142.

In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 3, 4, and 7. The first receptacle terminals 31 are held in the first insulated member 23 and formed as the upper-row terminals of the electrical receptacle connector 100. Each of the first receptacle terminals 31 comprises a flat contact portion 315, a body portion 317, and a tail portion 316. For each of the first receptacle terminals 31, the body portion 317 is held in the first insulated member 23, the flat contact portion 315 is extending forward from the body portion 317 in the rear-to-front direction and partly exposed upon the first surface 221*a* of the tongue portion 22, and the tail portion 316 is extending backward from the body portion 317 in the front-to-rear direction and protruding from the rear of the first insulated member 23. The first signal terminals 311 are disposed on the first surface 221*a* and transmit first signals (namely, USB 3.0 signals). The tail portions 316 are bent horizontally to form flat legs, named legs manufactured by SMT (surface mounted technology), which can be mounted or soldered on the surface of a printed circuit board by using surface mount technology. Alternatively, the tail portions 316 may be extending downwardly to form vertical legs, named legs manufactured by through-hole technology, which can be inserted into holes drilled in a printed circuit board (PCB). In addition, the overall width of the tail portions 316 is equal to the overall width of the body portions 317. Therefore, the tail portion 316 and the body portion 317 of each of the first receptacle terminals 31 are aligned along the same line, and the distance between two adjacent tail portions 316 correspond the distance between two adjacent contacts 81 of the circuit board 8.

Please refer to FIGS. 3, 4, and 7. The second receptacle terminals 41 comprise a plurality of second signal terminals 411, power terminals 412, and ground terminals 413. The second receptacle terminals 41 comprise a plurality of pairs of second high-speed signal terminals 4111/4113 and a pair of second low-speed signal terminals 4112. Referring to FIG. 7, the second receptacle terminals 41 comprise, from right to left, a ground terminal 413 (Gnd), a first pair of second high-speed signal terminals 4111 (TX2+−, differential signal terminals for high-speed signal transmission), a power terminal 412 (Power/VBUS), a second function detection terminal 4141 (CC2, a terminal for inserting orientation detection of the connector and for cable recognition), a pair of second low-speed signal terminals 4112 (D+−, differential signal terminals for low-speed signal transmission), a supplement terminal 4142 (SBU2, a terminal can be reserved for other purposes), another power terminals 412 (Power/VBUS), a second pair of second high-speed signal terminals 4113 (RX1+−, differential signal terminals for high-speed signal transmission), and another ground terminal 413 (Gnd). In this embodiment, twelve second receptacle terminals 41 are provided for transmitting USB 3.0 signals. Each pair of the second high-speed signal terminals 4111/4113 is between the corresponding power terminal 412 and the adjacent ground terminal 413. The pair of the second low-speed signal terminals 4112 is between the second function detection terminal 4141 and the supplement terminal 4142.

In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 3, 4, and 7. The second receptacle terminals 41 are held in the second insulated member 25 and formed as the lower-row terminals of the electrical receptacle connector 100. In addition, the first receptacle terminals 31 are substantially aligned parallel with the second receptacle terminals 41. In this embodiment, each of the second receptacle terminals 41 comprises a flat contact portion 415, a body portion 417, and a tail portion 416. For each of the second receptacle terminals 41, the body portion 417 is held in the second insulated member 25 and the tongue portion 22, the flat contact portion 415 is extending from the body portion 417 in the rear-to-front direction and partly exposed upon the second surface 221*b* of the tongue portion 22, and the tail portion 416 is extending backward from the body portion 417 in the front-to-rear direction and protruding from the rear of the second insulated member 25. The second signal terminals 411 are disposed at the second surface 221*b* and transmit second signals (i.e., USB 3.0 signals). The tail portions 416 are bent horizontally to form flat legs, named legs manufactured by SMT (surface mounted technology), which can be mounted or soldered on the surface of a printed circuit board by using surface mount technology. Alternatively, the tail portions 416 may be extending downwardly to form vertical legs, named legs manufactured by through-hole technology, which can be inserted into holes drilled in a printed circuit board (PCB). The tail portions 316 of the first receptacle terminals 31 and the tail portions 416 of the second receptacle terminals 41 are arranged in a staggered manner from the top view.

Please refer to FIGS. 3, 4, and 7. In this embodiment, a front end 315*a* of each of the first receptacle terminals 31 is extending to form a hook structure from a front portion of the corresponding flat contact portion 315. For the same first receptacle terminal 31, the front end 315*a* is opposite to the tail portion 316. Additionally, after the tongue portion 22 is formed, the front ends 315*a* of the first receptacle terminals 31 are covered by the tongue portion 22, but embodiments are not limited thereto. In some embodiments, the front ends 315*a* of the first receptacle terminals 31 are inserted to the tongue portion 22. Accordingly, the flat contact portions 315 can be positioned on the first surface 221*a* of the tongue portion 22 firmly. Hence, the flat contact portions 315 of the electrical receptacle connector 100 would not detach off the first surface 221*a* of the tongue portion 22 after the connector is used for a period.

Please refer to FIGS. 3, 4, and 7. In this embodiment, a front end 415*a* of each of the second receptacle terminals 41 is extending to form a hook structure from a front portion of the corresponding flat contact portion 415. For the same second receptacle terminal 41, the front end 415*a* is opposite to the tail portion 416. Additionally, after the terminal positioning portion 252 is formed, the front ends 415*a* of the second receptacle terminals 41 are covered by the terminal positioning portion 252; that is, the flat contact portions 415 are positioned with the terminal positioning portion 252, and the front ends 415*a* of the flat contact portions 415 are held in the disposing surface 253 of the terminal positioning portion 252. In this embodiment, the terminal positioning portion 252 is formed by insert-molding techniques to enclose the front ends 415*a* of the second receptacle terminals 41, but embodiments are not limited thereto. In some embodiments, the front ends 415*a* of the second receptacle terminals 41 are inserted to the terminal positioning portion 252. Accordingly, the flat contact portions 415 can be positioned on the second surface 221*b* of the tongue portion 22 (i.e., on the exposed surface of the terminal positioning portion 252) firmly. Hence, the flat contact portions 415 of the electrical receptacle connector 100 would not detach off the terminal positioning portion 252 after the connector is used for a period.

Please refer to FIGS. 2 and 4. The legs 72 are extending from the rear portion of the grounding plate 7 to form vertical legs. That is, the legs 72 are exposed from the second insulated member 25 and in contact with the circuit board 8. In this embodiment, the crosstalk interference can be reduced by the shielding of the grounding plate 7 when the flat contact portions 315, 415 transmit signals. Furthermore, the structural strength of the tongue portion 22 can be improved by the assembly of the grounding plate 7. In addition, the legs 72 of the grounding plate 7 are exposed from the second insulated member 25 and in contact with the circuit board 8 for conduction and grounding.

Please refer to FIGS. 1, 2, and 4. The grounding plate 7 further comprises a plurality of hooks 73. The hooks 73 are extending outward from two sides of the front portion of the plate body 71 and protruding out of the front lateral surface 221*c* and two sides of the tongue portion 22. When an electrical plug connector is mated with the electrical receptacle connector 100, elastic pieces at two sides of an insulated housing of the electrical plug connector are engaged with the hooks 73, and the elastic pieces would not wear against the tongue portion 22 of the electrical receptacle connector 100. Hence, the grounding plate 7 can be in contact with the metallic shell 11 for conduction and grounding.

Please refer to FIGS. 1, 3, and 7. In this embodiment, the first receptacle terminals 31 and the second receptacle terminals 41 are disposed upon the first surface 221*a* and the second surface 221*b* of the tongue portion 22, respectively, and pin-assignments of the first receptacle terminals 31 and the second receptacle terminals 41 are point-symmetrical with a central point of the receptacle cavity 112 as the symmetrical center. In other words, pin-assignments of the first receptacle terminals 31 and the second receptacle terminals 41 have 180-degree symmetrical design with respect to the central point of the receptacle cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 221*a* is facing up, for transmitting first signals. Conversely, the electrical plug connector is inserted into the electrical receptacle connector 100 with a second orientation where the first surface 221*a* is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Please refer to FIG. 1 and FIGS. 3 to 7. In this embodiment, as viewed from the front of the receptacle terminals 31, 41, the position of the first receptacle terminals 31 corresponds to the position of the second receptacle terminals 41. In other words, the positions of the flat contact portions 315 are respectively aligned with the positions of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. Accordingly, because of the offset alignment of the flat contact portions 315, 415, the crosstalk between the first receptacle terminals 31 and the second receptacle terminals 41 can be reduced during signal transmission. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of the first high-speed signal terminals 3111 (TX1+−) and the second pair of the first high-speed signal terminals 3113 (RX2+−) are omitted, and the pair of the first low-speed signal terminals 3112 (D+−) and the power terminals 312 (Power/VBUS) are retained. While for the second receptacle terminals 41 in accordance with transmission of USB 2.0 signals, the first pair of the second high-speed signal terminals 4111 (TX2+−) and the second pair of the second high-speed signal terminals 4113 (RX1+−) are omitted, and the pair of the second low-speed signal terminals 4112 (D+−) and the power terminals 412 (Power/VBUS) are retained.

Accordingly, the tongue portion is integrally formed on the front end of the mount member to enclose the terminal positioning portion and the grounding plate, so that the front ends of the flat contact portions of the first receptacle terminals are held in the first surface of the tongue portion and the front ends of the flat contact portions of the second receptacle terminals are held in the second surface of the tongue portion. The tongue portion encloses the front end of the second insulated member and integrates with the second insulated member, so that the tongue portion can be firmly positioned with the first receptacle terminals, the second receptacle terminals, the first insulated member, and the second insulated member. Therefore, when the connector is impacted by a foreign force, the components of the connector would not detach from each other easily. In addition, after the assembling procedures, the surface of the tongue portion and the surface of the mount member are different in texture for indicating different forming procedures. Moreover, the front portions of the first and second receptacle terminals are covered by the tongue portion and the terminal positioning portion, respectively. Accordingly, the flat contact portions of the electrical receptacle connector would not detach off the tongue portion and the terminal positioning portion after the connector is used for a period.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell comprising a receptacle cavity;

a mount member received in the receptacle cavity of the metallic shell, wherein the mount member comprises a first insulated member and a second insulated member assembled with each other, wherein second insulated member comprises a base and a terminal positioning portion extending from one side of the base and on the second surface of the tongue portion, the second insulated member comprises a plurality of sidewalls and an assembling portion, the sidewalls are outward extending from two sides of the base in a same direction, the assembling portion is between the sidewalls, the first insulated member is positioned on the assembling portion, and two sides of the first insulated member are engaged with the sidewalls, respectively;

a plurality of first receptacle terminals on the first insulated member of the mount member, wherein each of the first receptacle terminals comprises a first flat contact portion and a first tail portion extending from one end of the first flat contact portion and protruding from the mount member;

a plurality of second receptacle terminals on the second insulated member of the mount member, wherein each of the second receptacle terminals comprises a second flat contact portion and a second tail portion extending from one end of the second flat contact portion and protruding from the mount member;

a grounding plate on the second insulated member of the mount member and between the first flat contact portions and the second flat contact portions; and a tongue portion integrally formed with a front end of the mount member to enclose the grounding plate, wherein the first flat contact portions are on a first surface of the tongue portion, the second flat contact portions are on a second surface of the tongue portion, front ends of the first flat contact portions are held in the first surface of the tongue portion, and front ends of the second flat contact portions are held in the second surface of the tongue portion, wherein the second surface of the tongue portion and the terminal positioning portion are at a same horizontal plane.

2. The electrical receptacle connector according to claim 1, wherein the tongue portion comprises a specific portion and an assembling portion opposite to the specific portion, the terminal positioning portion is on the specific portion, the terminal positioning portion is held in the tongue portion, a surface texture of a surface of the terminal positioning portion opposite to the abutting surface is different from a surface texture of the second surface of the tongue portion.

3. The electrical receptacle connector according to claim 2, wherein the surface of the terminal positioning portion and the second surface of the tongue portion are at a same horizontal plane.

4. The electrical receptacle connector according to claim 1, wherein the tongue portion is integrally formed with the front end of the mount member to enclose the terminal positioning portion.

5. The electrical receptacle connector according to claim 1, wherein the tongue portion comprises a separating portion surrounding a periphery of a rear portion of the tongue portion and near to the front end of the mount member.

6. The electrical receptacle connector according to claim 1, wherein the first receptacle terminals are on the first surface of the tongue portion, the second receptacle terminals are on the second surface of the tongue portion, and wherein the first receptacle terminals and the second receptacle terminals have 180 degree symmetrical design with respect to a central point of the receptacle cavity as the symmetrical center.

7. An electrical receptacle connector, comprising:

a metallic shell comprising a receptacle cavity;

a mount member received in the receptacle cavity of the metallic shell, and the mount member comprising a first insulated member and a second insulated member assembled with each other, wherein the first receptacle terminals are on the first insulated member, the second receptacle terminals and the grounding plate are on the second insulated member, wherein the second insulated member comprises a plurality of protrusions on an abutting surface of the terminal positioning portion;

a plurality of first receptacle terminals on a first side of the mount member, wherein each of the first receptacle terminals comprises a first flat contact portion and a first tail portion extending from one end of the first flat contact portion and protruding from the mount member, wherein the protrusions abut against the first flat contact portion;

a plurality of second receptacle terminals on a second side of the mount member opposite to the first side, wherein each of the second receptacle terminals comprises a second flat contact portion and a second tail portion extending from one end of the second flat contact portion and protruding from the mount member;

a grounding plate on the mount member and between the first flat contact portions and the second flat contact portions; and a tongue portion integrally formed with a front end of the mount member to enclose the grounding plate, wherein the first flat contact portions are on a first surface of the tongue portion, the second flat contact portions are on a second surface of the tongue portion, front ends of the first flat contact portions are held in the first surface of the tongue portion, and front ends of the second flat contact portions are held in the second surface of the tongue portion.

8. The electrical receptacle connector according to claim 7, wherein the grounding plate comprises a plurality of positioning holes, the protrusions pass through the positioning holes so as to be positioned with the grounding plate.

9. An electrical receptacle connector, comprising:

a plurality of first receptacle terminals held in a first insulated member, wherein each of the first receptacle terminals comprises a first flat contact portion;

a plurality of second receptacle terminals held in a second insulated member along with a grounding plate, wherein each of the second receptacle terminals comprises a second flat contact portion, the second insulated member has a terminal positioning portion positioned with the second flat contact portions, the terminal positioning portion comprises a disposing surface, front ends of the second flat contact portions are held in the disposing surface;

a tongue portion, a first surface thereof comprising an assembling portion and a second surface thereof opposite to the first surface comprising a specific portion, wherein the first flat contact portions are positioned with the assembling portion, front ends of the first flat contact portions are held in the assembling portion, the terminal positioning portion is held in the tongue portion, the disposing surface of the terminal positioning portion and the specific portion of the tongue portion are at a same plane, and a surface texture of the terminal positioning portion is different from a surface texture of the specific portion; and a metallic shell comprising a receptacle cavity for receiving the first receptacle terminals and the second receptacle terminals.

10. The electrical receptacle connector according to claim 9, wherein the second insulated member comprises a plurality of protrusions on a surface of the terminal positioning portion opposite to the disposing surface to abut against the first flat contact portions.

11. The electrical receptacle connector according to claim 9, wherein the tongue portion comprises a separating portion surrounding a periphery of a rear portion of the tongue portion and near to a front end of an assembly of the first insulated member and the second insulated member.

* * * * *